US007014391B2

(12) United States Patent
Starheim et al.

(10) Patent No.: US 7,014,391 B2
(45) Date of Patent: Mar. 21, 2006

(54) PORTABLE ENVIRONMENTAL CONTAINMENT SYSTEM

(76) Inventors: Scot A. Starheim, 1112 W. 77th Ave., Anchorage, AK (US) 99518; Bruce D. Ross, 2749 45th Ave SW., Seattle, WA (US) 98116

( * ) Notice: Subject to any disclaimer, the term of this patent is extended or adjusted under 35 U.S.C. 154(b) by 18 days.

(21) Appl. No.: 10/712,132

(22) Filed: Nov. 13, 2003

(65) Prior Publication Data

US 2004/0096276 A1 May 20, 2004

Related U.S. Application Data

(60) Provisional application No. 60/426,128, filed on Nov. 13, 2002.

(51) Int. Cl.
*E02B 7/00* (2006.01)

(52) U.S. Cl. ..... 405/129.8; 405/129.6; 405/129.55

(58) Field of Classification Search ..... 405/114, 405/107, 115, 129.45, 129.55, 129.6, 129.75, 405/129.8
See application file for complete search history.

(56) References Cited

U.S. PATENT DOCUMENTS 5,098,220 A 3/1992 Norman
5,236,281 A 8/1993 Middleton
5,454,195 A * 10/1995 Hallsten ..... 405/114
5,520,477 A 5/1996 Fink
5,689,920 A * 11/1997 Hallsten ..... 405/114
5,800,091 A 9/1998 Van Roemer
5,820,297 A 10/1998 Middleton
5,857,304 A 1/1999 Karten
5,882,142 A 3/1999 Siglin et al.
6,315,495 B1 11/2001 Starheim

* cited by examiner

*Primary Examiner*—Frederick L. Lagman

(57) ABSTRACT

A temporary berm or bin system, easily transported, erected without tools, and easily dismantled. A set of panels or planks is joined with sliding clips to form a bin having vertical or near vertical sides. The bin is lined with an impervious sheet of geocloth to form a containment berm for use in controlling the dispersal of hazardous material spilled from storage or work facilities. Spring loaded clamps hold the geocloth securely to the uppermost plank without nailing, sewing, or other labor consuming and/or tear prone methods. The berm is particularly suited to protect oil well drilling sites in environmentally sensitive environments such as arctic tundra. No excavation or other disturbance of the soil is required to erect the protective berm. The berm is secured to the ground by spiking through triangular support gussets. In the arctic, securing may be accomplished by freezing ice or mud as an "ice mortar" over the gusset feet and along the lower edge of the planking. The berm system may be transported by ordinary truck, specially adapted transport/laying truck, or on a portable drilling platform.

3 Claims, 13 Drawing Sheets

7
4

11
7
4

12
14
13
15
16
17
15

7
4
12
14

7
4
2
7
4
14

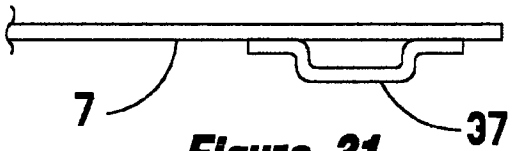
Figure 31
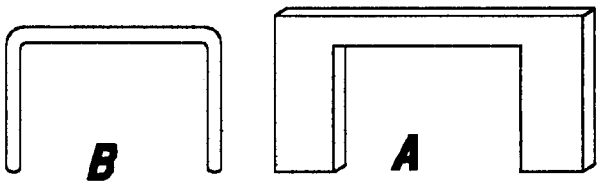
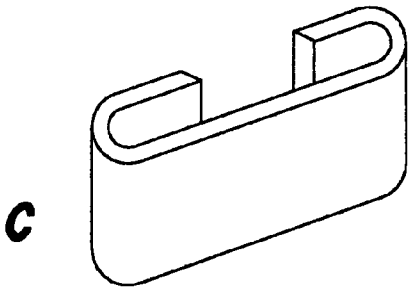
Figure 21
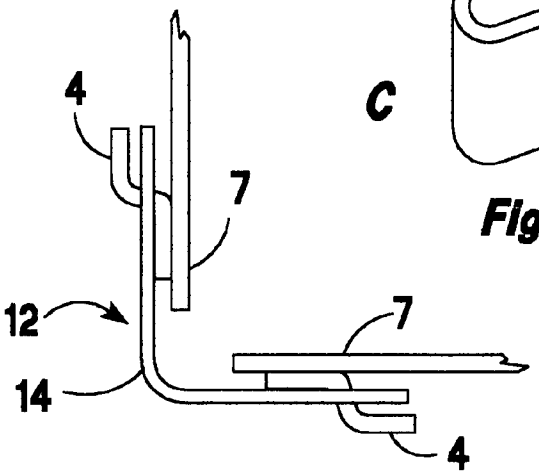
Figure 18
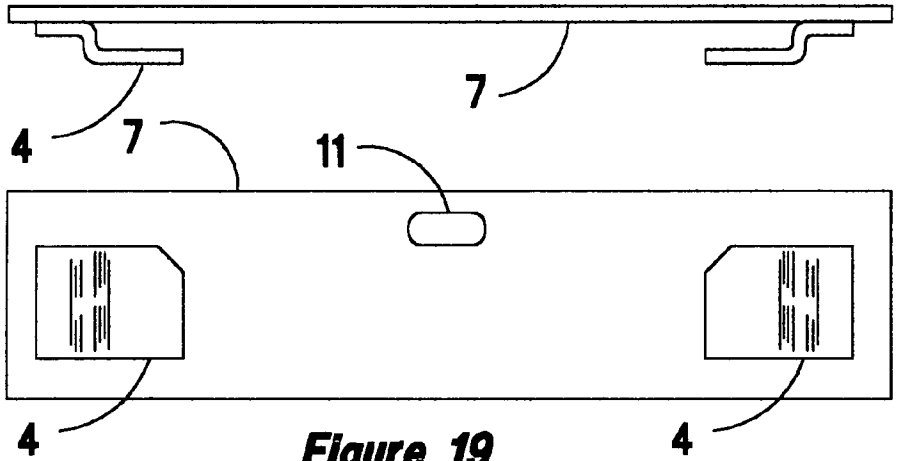
Figure 19
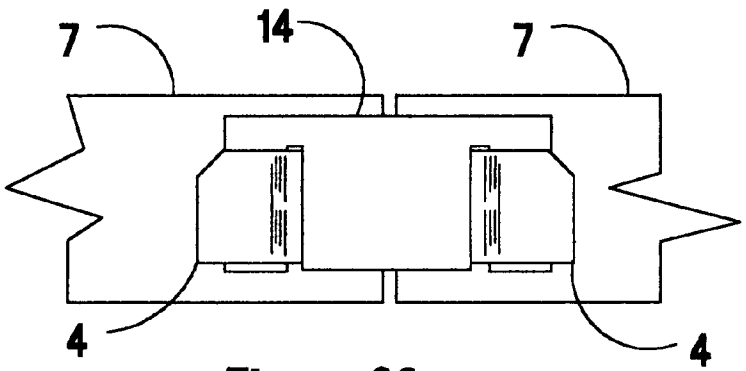
Figure 20

7
39
40
39
44
A 7
7
43
42
7

B
C
D
E
F 7
46
45
47
7

7
46
48

7
46
48

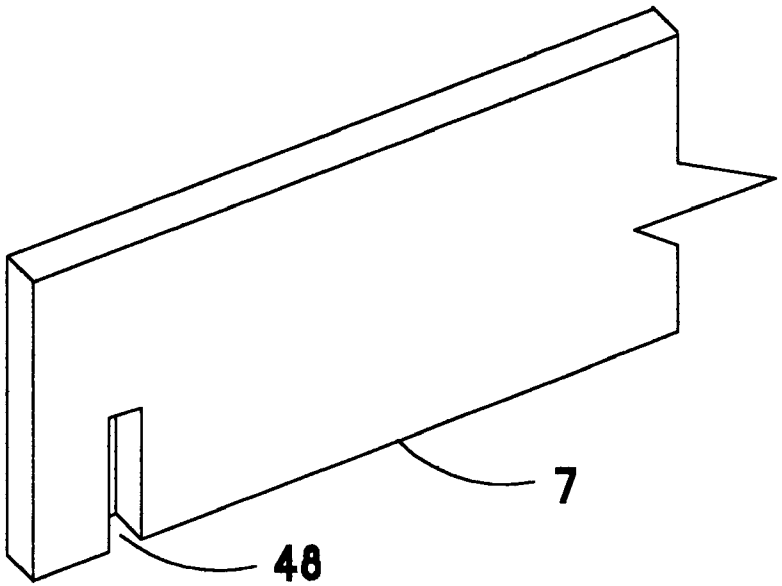
Figure 38
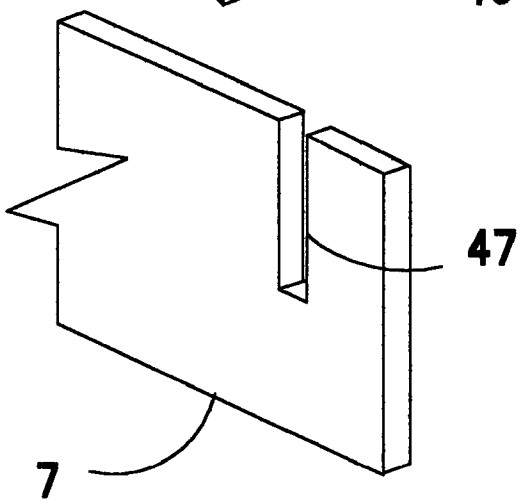
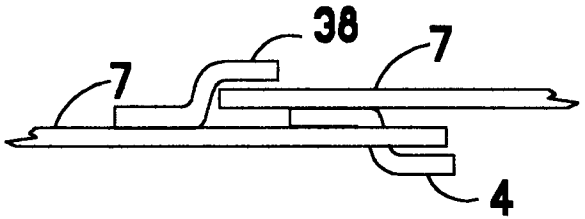
Figure 37

PORTABLE ENVIRONMENTAL CONTAINMENT SYSTEM

RELATED APPLICATIONS

The present application claims benefit of filing date of Provisional Application No. 60/426,128 titled Portable Environmental Containment System, filed on Nov. 13, 2002, now abandoned.

The present application describes additional embodiments for the containment system described in U.S. Pat. No. 6,315,495. U.S. Pat. No. 6,315,495 is incorporated by reference.

BACKGROUND OF THE INVENTION

1. Field of Invention

This invention pertains to temporary structures serving as retaining berms or bins for holding hazardous material against escaping. In particular, to prevent oil well drilling mud and other fluids released during drilling operations from escaping the site, and to protect the environment near the tank batteries used for holding drilling fluids, fuel, and supplies. The system may be stored and transported as part of a drilling rig.

2. Description of Prior Art

In environments where the soil may be disturbed, earth is piled up in berms to form a closed area then covered with an impervious sheet of geocloth or similar. Earth berms require heavy equipment to scoop and pile dirt and to push it back into place when the need for the holding pen is over. In environments where the soil cannot be disturbed, is too hard, or is delicate tundra, timbers such as old railroad ties are stacked as a pen and the impervious geocloth secured to the timbers by nailing. The timber berms require heavy equipment to place and remove. Timbers generally are too heavy to handle without machinery and if treated with creosote or other preservatives, they may leach toxic chemicals into the ground where they are placed. This small but significant contamination has to be scooped up and removed for proper disposal. The heavy timbers require larger hauling equipment and more storage space than the invention described herein.

The patent literature shows several portable or temporary holding, berm-like, structures. Most are for special purposes, not suitable for general or arctic use.

U.S. Pat. No. 5,098,220, by Carol Norman, shows a shallow pit lined with an impervious sheeting surrounding an oil well head. The marginal attachment is not shown and the text indicates that there are several methods in use. The railroad ties described above are likely to be one suitable means. Miss Norman's invention is intended for finished wells, and is insufficient for use as protection during the drilling operation.

U.S. Pat. No. 5,236,281, by Dennis Middleton, describes a polyurethane dike device (berm) for use on concrete floors. Sections of the berm or dike are joined by gluing a form-fitting molded splice piece across the interstitial space between adjacent linear sections. The assembly cannot be disassembled without destroying at least part of the components, rendering them not reusable.

U.S. Pat. No. 5,820,297, also by Dennis Middleton, is a similar device. It is foam filled and designed to be glued to a flat floor. Joining is by gluing a splice piece cut from sheet stock over the joint.

U.S. Pat. No. 5,800,091, by Edward Van Romer, is another dike similar to the Middleton invention, except that the supporting structure is pneumatic and the dike is sufficiently pliable to permit a wheeled vehicle to roll over the wall portion.

U.S. Pat. No. 5,520477, by Kevin Fink, uses honeycomb core panels connected by H shaped joiners in cooperation with clips having securing barbs. At first glance the clips resemble the membrane-holding clips of the present invention. However, examination discloses that the barbs are not for holding any third component (membrane) in place. They are intermediaries between the panel edges and the H joining bar. The barbs fit into cooperating grooves or holes in the panel and H bar. The Fink figures clearly show this. In particular, FIGS. 4–12.

The Fink panel joining and corner assemblies have no resemblance to the structures of the present invention.

U.S. Pat. No. 5,857,304, by Stuart Karten, et al, has a key-way cut into the ends of the panels and a key system sliding into the key-ways, thereby joining two panels together. The present invention has no key-ways.

U.S. Pat. No. 5,882,142, by Donald Siglin, et al, is a permanent containment dike comprising panels bolted to posts set into concrete and lined with an impervious sheet of geotextile, which is secured to the upper rim of the wall by bolted clamps. This system requires considerable labor, precision placement of the posts, and does environmental damage. In contrast to the present invention, Siglin bolts the panels at overlapping joints The Siglin invention uses nuts and bolts as joining fasteners. Nuts and bolts rust tight, making the Siglin dike un-repairable in the best of working conditions. Stainless steel or brass nuts and bolts may reduce the seizing problems at great expense. However, under arctic conditions, the normally simple chore of starting a nut on a bolt, then tightening with a pair of wrenches is a very difficult task. Loosening and removing nuts and bolts which may be frozen in place with ice is also more difficult than expected. Nuts and bolts and wrenches are awkward to handle with arctic gloves and are likely to be dropped, leaving a litter.

The present invention has no nuts and bolts.

The Siglin dike uses posts set in concrete to support the wall sections. Concrete does not set well in freezing conditions. Thus, the Siglin dike cannot be installed in winter in many parts of the world, especially in permafrost zones.

The present invention does not rely on concrete. Furthermore, the present invention can utilize arctic cold to make an "ice mortar" or "ice-crete" of ice, frozen mud, or the like, for holding the structure in place.

OBJECTS OF THE INVENTION

It is an object of the present invention to construct a temporary containment berm using reusable panel modules and other component parts requiring no machinery or power tools to assemble or disassemble.

It is another object of the present invention to be reusable and leave no environmental impact behind when removed.

It is another object of the present invention to be able to construct a temporary containment berm using panel modules and other component parts fabricated from metal or composite sheet stock.

It is another object of the present invention to be able to repair the berm on-site with hand tools or common hand-held power tools.

It is another object of the present invention that the invention be usable under arctic conditions including while wearing cumbersome arctic gloves and other gear.

It is another object of the present invention to be transportable by truck and manually installed.

It is another object of the invention to be transportable on an erection truck, trailer, or skid module using the transporter to place the liner and other components.

It is another object of the invention to be removably attached to a drilling rig, thereby being transported as part of a drilling rig or platform.

It is another object of the invention that the berm confines the spread of liquids or slurries.

SUMMARY OF THE INVENTION

Panels or planks are cut from sheet stock, generally ¼ to ½ inch aluminum flat stock. Z or jogged plates are attached near the panel ends forming hooks to co-operate with hooking clips for joining panels. In the central portion of the panels the hooks are arranged in pairs forming a track or key-way slots to accept triangular load supporting gusset brackets having pads for supporting weight and having wings which slide into the key-ways.

The panel end hooks accept hooking clips which are either flat for joining plates in-line or corners bent to form dihedral angles to form bin corners. Clips designed for in-line joining are essentially flat and co-operate with the jogged plates to clip into the end hooks to hold the panels end to end forming long berm or bin walls. The clips for joining panels end to end also carry key-way slots similar to the key-way slots on the panels. Support brackets attach to the joining clips in the same manner as used to attach directly to the panels.

The corner clips are bent an appropriate amount to turn the bin wall. This is usually 90 degrees, but may be any amount. Other preferred turning is 135 degrees internal angle for octagon berms and 157.5 degrees internal angle for 16 sided, approximately circular berms. Others may be bent as required, or a hinged corner piece may be used. No support gussets are required at the corners.

Panels may be in several lengths, widths (height), and thicknesses, the preferred panel lengths being 4, 6, and 8 feet in length. The preferred panel width is 12 to 24 inches. The preferred panel thickness is ¼ to ½ inch.

Rows of panels are stack able using gusset brackets which are large enough to span more than one row. The gussets then act as tie studs between the stacked panels. The larger gussets capable of spanning two or more stacked rows are automatically scaled to support the larger loads expected when the berm or bin becomes filled.

Sections can be removed easily to permit passage of vehicles bringing in supplies or removing equipment then easily replaced by workmen of the skill levels and tools commonly found around drilling operations. Similarly, accidentally damaged sections can be quickly and inexpensively replaced, thus avoiding fines and other complications from possible violation of environmental protection laws.

BRIEF DESCRIPTION OF THE DRAWINGS

FIG. 18 shows the panel hooks turned inward and function equivalently to the original direction.

FIG. 19 is a full view of a panel and showing the panel hooks turned inward.

FIG. 20 shows the panel hooks turned inward and function equivalently to the original direction.

FIGS. 21 A, B, and C are alternate embodiments of joining clips for use with the inward facing panel hooks.

FIG. 31 shows another embodiment of the panel joining hooks.

FIG. 37 shows another alternative joining method using panel hooks

FIG. 38 shows two panels with slots for joining at right angles.

INDEX OF DETAILED ELEMENTS

1. Berm assembly, general

2. Support bracket assembly, general

Figure 1:
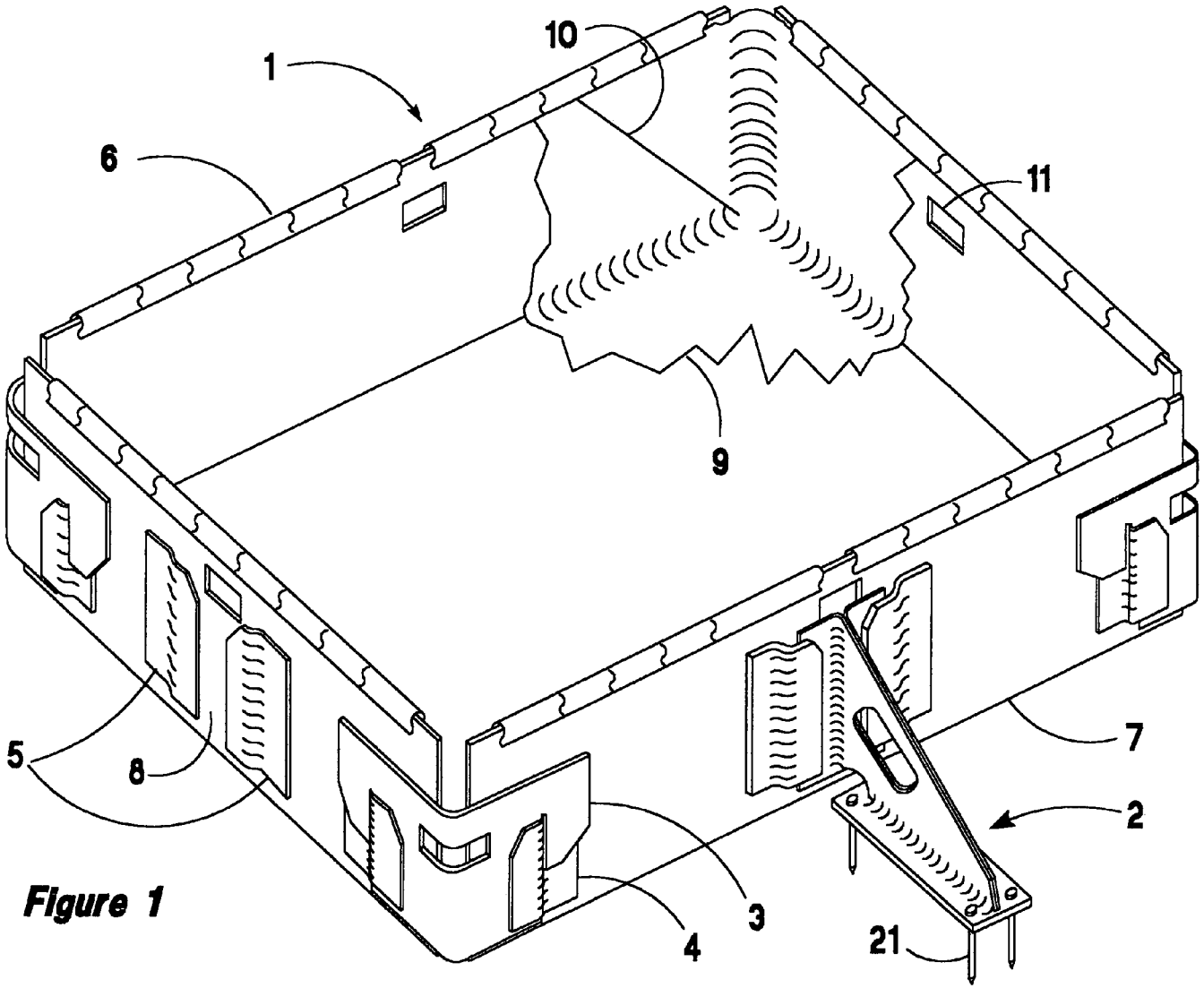
FIG. 1 is an isometric view of an embodiment of the assembled invention.

3. Corner joining clip with hooks
4. Joining hook, part of panel
5. Support bracket attachment hook
6. Liner retaining clamp
7. Berm wall panel
8. Support bracket attachment slot
10. Liner fold
11. Panel hand hold
12. Joining clip, general
13. Hand hold in clip
14. Joining clip blank
15. Receiving slot for panel hook.
16. Gusset retaining hook (pair)
17. Gusset receiving slot
18. Bracket foot
19. Spike receiving holes in bracket foot
20. Gusset
21. Hand hold or lightening cutout
22. Gusset wings
23. Panel with integral supporting bracket or gussets, general.
24. Fixed support gusset or bracket
25. Hand hold.
26. Mounting holes for attaching to a drill rig.
27. Hold down spike
28. Hold down pad
29. Low berm embodiment, general
30. Low berm wall
31. Low berm footing
32. Low berm joining slot
33. Low berm foot wings
34. Low berm joining piece, general
35. Low berm joining tang
36. Alternative joining clip, general
37. Alternative panel hook as a closed pocket.
38. Alternative hook on reverse side to engage a panel.
39. Panel latching notch.
40. U shaped locking clamp.
40*a, b, c, d, e*. Alternate locking clamps
41. Unused
42. Panel hole for locking.
43. Key hole for locking
44. Tie hole on U clamp
45. Panel bent end plate
46. Panel joining slot
47. Panel joining slot
48. Enlarged panel joining slot, for 0 to 90 degree connection
49. Integral panel joining J hook.
50. Retro-bend on panel end
51. Securing hole through 4 layers.
52. Securing hole through 1 layer
53. Sliding clamp (general)
54. Clamping beak portion of clamp
55. Slider portion of clamp
56. J hook for bottom of panels
57. Wooden waler
58. Groove for liner and cord
59. Cord or elastic noodle.
60. Alternative for groove.
61. Pivoted joining hook
62. Hook pivoting means
63. Hooking slot
64. Co-operating hooking pin.
65. Alignment wings
66. Pinning hole in alignment wings
67. Co-operating pinning hole in adjacent panel
68. Securing pin
69. Co-axial or offset joining pin
70. Hole for retaining pin.
71. Extension wings for receiving joining pins

DETAILED DESCRIPTION OF THE PREFERRED EMBODIMENT(S):

FIG. 1 illustrates an assembled embodiment of the present invention, 1. The components illustrated are the berm wall panels 7, a support gusset bracket 2, corner clips 3, panel joining hooks 4, and the bracket mounting hooks 5, which form a T slot 8 into which the support bracket 2 is inserted, liner retaining spring clamps 6, spikes 21, and the liner 9.

Figures 2, 3, 4, 5, 6:
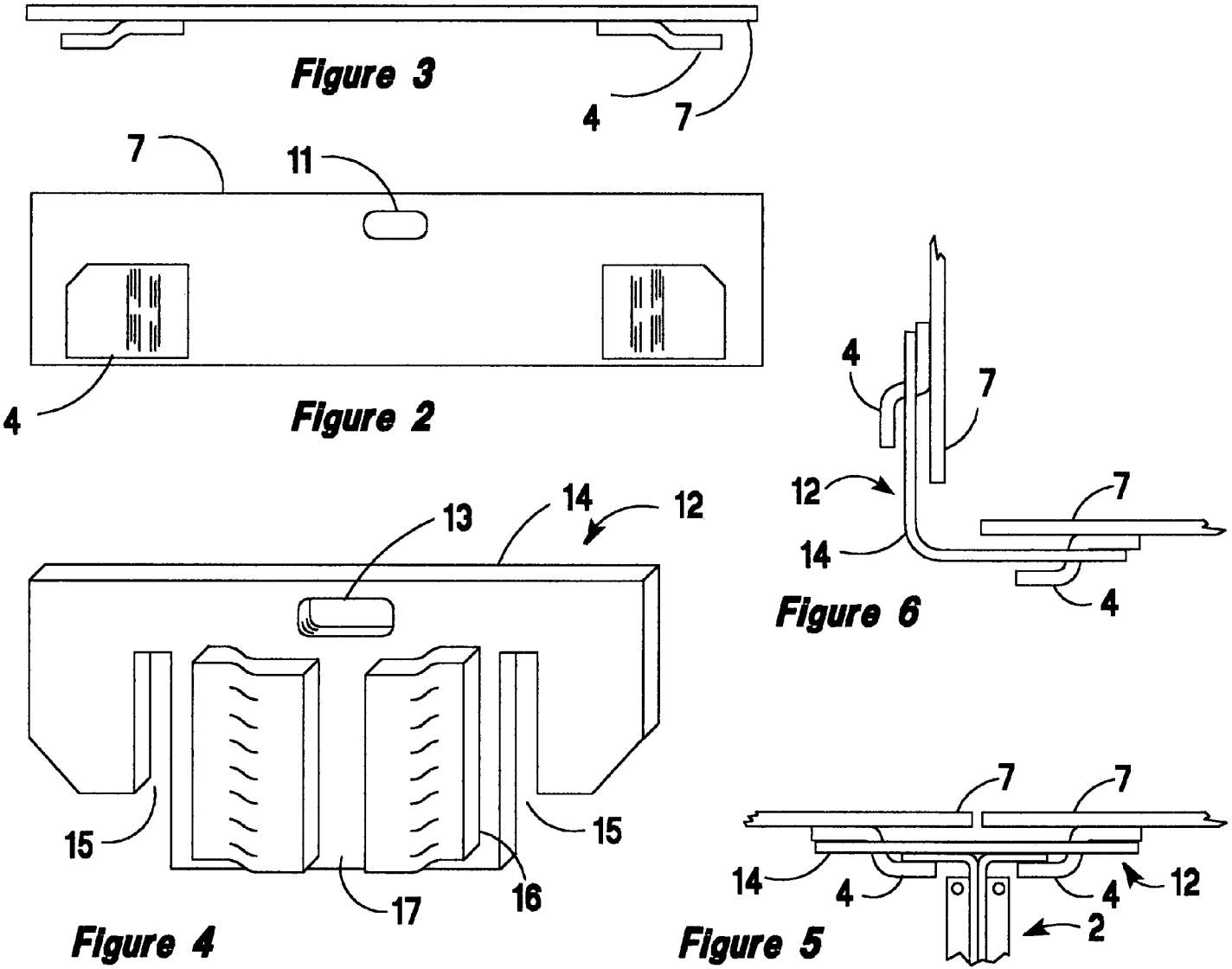
FIG. 2 is a front view of a typical panel module.
FIG. 3 is an edge view of a typical panel module showing the assembly hooks.
FIG. 4 is a view of the joining clip assembly.
FIG. 5 is an edge view of an assembled panel joint showing an installed joining clip and gusset bracket.
FIG. 6 is an edge view of an installed corner bracket.

FIGS. 2 and 3 are orthographic views of a typical panel. The panel has joining hooks, 4, at each end comprising jogged plates welded, bolted, or riveted to the panel. The end hooks slidably engage slots in cooperating joining clips to connect adjacent panels into longer runs or to form corners. Clips on the interior portions of the panels accept gusset brackets which serve as footing to prevent the panels from sinking into the ground and resist overturning. The brackets 2 have holes through which securing spikes are driven into the ground, warehouse floor, or other surface to prevent bracket sliding and panel bowing.

Figures 11, 12, 13:
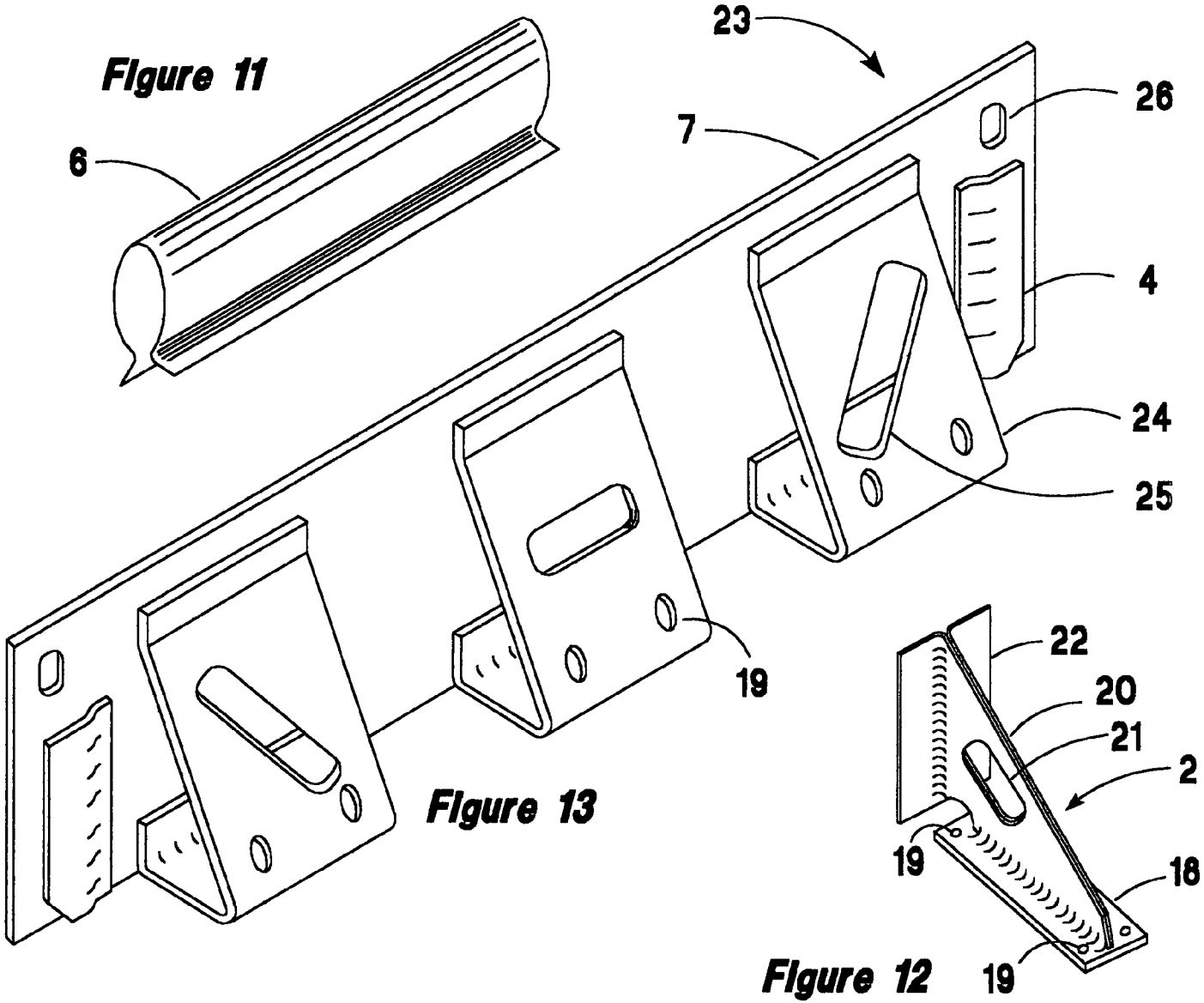
FIG. 11 is an isometric view of the liner holding spring clamp.
FIG. 12 is an isometric view of a typical support gusset bracket.
FIG. 13 is an isometric view of an alternate embodiment showing a preassembled panel.

FIG. 4 shows a typical panel joining clip assembly 12. A clip consists of a flat plate 14 with slots 15 and bracket hooks 16 symmetrically located around a center line. The bracket hooks face each other and form a T slot 17 for receiving a support gusset bracket, which is also shown in FIGS. 1, 4, and 12. A hand hold, 13, is generally included for handling the clip with one hand.

When the joining clip is used to connect two panels, the two clip-plate slots 15 straddle the jogs of the joining hooks 4 of adjacent panel ends as shown in FIGS. 5 and 6. This locks the adjacent panels in position, preventing the two panels from either separating or moving together in an overlap, while permitting a modest amount of angling between adjacent berm panel. The clip base plate 14 may be jogged at slots 15 to provide a closer fit against the plank panel 7. The slots 15 may also be tilted inward or outward to permit adjacent panels to be angled vertically. Alternatively, the joining clip can be fitted with a pivot for accommodating vertical angling.

Corner clips 3 are similar to the in-line joining clips of FIG. 4 except that corner clips do not have the gusset bracket hooks 16 and are bent as illustrated in FIG. 6. The most common corner bracket is bent 90 degrees. However other angles, in particular 135 and 157.5 degrees interior angle are particularly useful. Clips of 135 degrees makes a 45 degree turn in the berm wall, and 157.5 degree clips make a 22.5 degree turn. Of course, custom bending or hinged corner pieces may be utilized to turn a corner for specific purposes. Of particular use are corner pieces angled appropriately to form regular polygons such as 4, 5, 6, 8, 12, 16, and 32 sides. Polygons having six or more sides approach a circular shape. When pairs of longer panels are placed on opposite sides, the enclosure becomes approximately oval shaped. There is no requirement that the enclosure defined by the present invention be any specific shape. Irregular shapes may be constructed as needed to fit the requirements of the application.

FIGS. 1, 5, and 6 show the joining clip in use and illustrate the relationship of the various elements.

Clips for use where the expected loads are not severe may be fabricated from rod or bar stock as U-shaped staple-like clips. The bent ends of the rod being hooks to engage the joining hooks of the panels.

The portions of the flat-designed clips at the edges beyond the slots are themselves hooks similar in function and structure to the staple-like hook embodiments.

FIG. 12 is an isometric detail of a gusset bracket 2. The gusset bracket illustrated is an assembly of two triangular pans 20 fixedly connected by welding, bolting, riveting, or similar. A set of wings or ribs 22 is connected to the pan for attaching to the bin panel by sliding the wings into the joining clip or panel T slot 17 or 8. Further, a foot pad 18 is attached to the pans to serve as a foot support the gusset bracket and attached panel on the ground. The attaching wings slide into the T slot between the bracket hook plates 4 on the panels or the hook plates 16 on the joining clip. There is no need for gusset brackets at the bin corners, as the corner provides its own resistance to overturning. FIG. 5 show a joining clip assembly with a gusset bracket installed. The preferred fabrication material is aluminum sheet stock, but any materials suitable to purpose may be used, including other metals, composites, plastics, and wood. Thinner ribbed or corrugated sheet may be used, whereby the ribs or corrugations provide the necessary stiffness to the panels.

Hand holds are included wherever needed. At least one hand hold 11 at the center of each panel assembly is desired for carrying the panel. Aluminum panels are sufficiently light that only one centrally located hand hold is required for all except the longest models. The preferred hand holds are slots through which the hand is placed for gripping the panel. Handles of various shapes and locations are equally practical for manipulating the panels.

The formulae in Table I calculate typical forces to be expected on various parts and sizes of the berm structure. The calculations performed are illustrative and do not constitute a complete application design, and do not represent calculations of or to determine stress, strength, or section requirements, or consider the load bearing characteristics of the soil.

Figure 7:
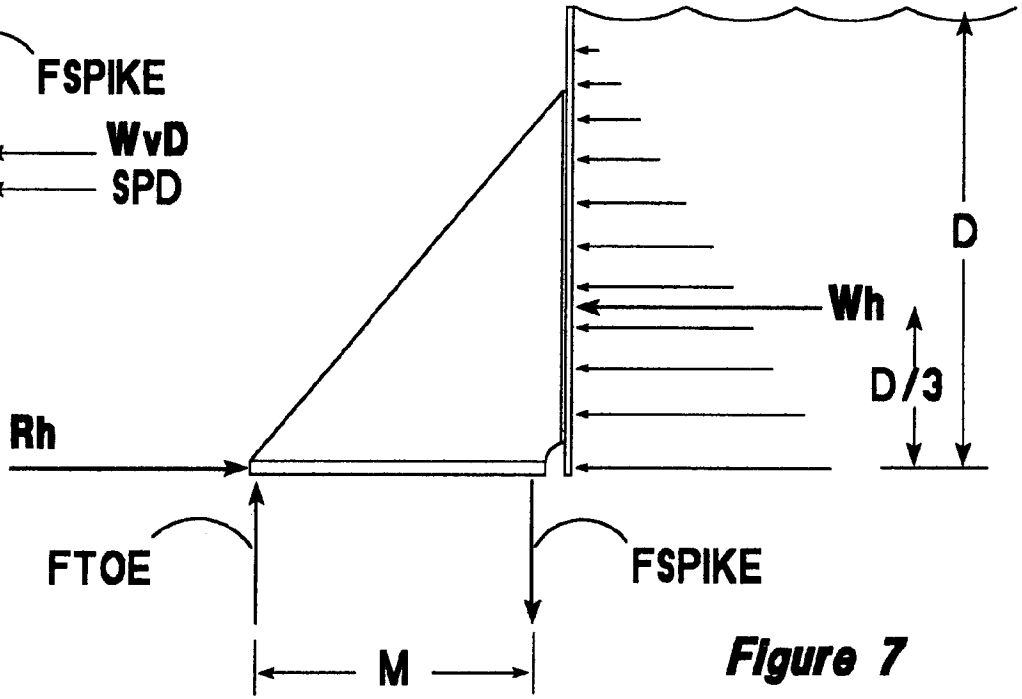
FIG. 7 is a free body diagram of a vertical berm wall

FIG. 7 illustrates that the fluid pressure is zero at the surface and maximum at the bottom. Integration indicates that the entire pressure can be represented by a single pressure operating on an area at ⅔ depth down from the surface. Another axiom of static free body analysis is that the all the forces can be represented by a set of vertical, horizontal, and torsional vector components. Each axis, vertical, horizontal, and torsional must be balanced to a net of zero. If not zero, the whole structure would be in motion, not static, by definition.

The largest overall forces are encountered when the bin is filled to the top. Refer to FIG. 7 for a free body diagram illustrating the points of action and directions the primary forces encountered in use. The small force vectors represent the incremental forces of small portions of the fluid being retained. These forces are summed (mathematically integrated using calculus) and combined into one equivalent force, Wh. Calculus also determines that the equivalent force acts on one point ⅓ up from the bottom of the fluid. Since all forces, in all linear and torsional axes, must sum to zero, the reaction forces can be calculated. For the configuration shown in FIG. 7; Rh=Wh, FTOE=FSPIKE, FTOE*M=WH*D/3. These calculations do not take into account the aiding forces provided by hydraulic pressure in the vicinity of the bottom corner of the liner.

Tables I and II set forth most of the basic principles and equations according to which calculations of the physical size and strength are made. These principals are universal and apply to vertical, sloped, and composite berm walls.

The equations of Table I indicate that the longer the foot, the smaller are the vertical forces on the foot.

For vertical walls, the toe force is upward, preventing the toe from sinking into the soil, and the heel force is downward and supplied by pinning to the ground. However an outward slope of only 10 degrees (80 from horizontal) takes advantage of the weight of the contents to provide a counter to the overturning moment. An offset of 20 degrees (70 from horizontal) will offset all overturning moments and not require any spiking tie-down whatsoever.

The horizontal restraint at the base is required to prevent the bracket from slipping along the ground or warehouse floor. It is resisted by side forces distributed among the pinning nails. The amount of force on each pin is incalculable, but is generally expected to be roughly equal.

The interior of the berm bin is lined with an unbroken sheet of appropriate material 9. The liner is usually an impervious sheet of material chemically compatible with the expected contents and other environmental conditions. A suitable liner for use around an oil well is "HYTREL™" polyester elastomer by Dupont. Generally liner 9 is a continuous sheet of flat stock with the excess material at the corners folded 10 along a bin side wall.

The liner may be a fabricated "box" using appropriate joining methods at the corners.

The liner is laid in to conform to the sides and bottom of the bin, extending to the rim and folded over a few inches. An omega shaped spring clamp as shown in FIGS. 1 and 11 is pressed over the rim of the bin, clamping the liner to the upper panel. The liner clamping clip may be made of any resilient material such as plastic, spring steel, or non-ferrous spring metals. In emergencies, a length of wood may be slotted and pressed into place over the panel edge.

TABLE I

GENERAL
FORMULAS FOR CALCULATING FOUNDATION LOADING

For vertical berm or bin wall

Use angle of 90 degrees
For berm or bin wall sloping outwardly alpha degrees from horizontal Assume the weight of the panels is zero
Length of Gusset foot = LF
Horizontal hydraulic force on panel = Wh = density * depth * depth/2
Downward force on panel = Wv = Wh * cotangent(alpha)
Overturning moment = Wh * depth/3
Horizontal distance from panel bottom edge to point of action of vertical force = WvD = (D/3)/Tangent(ALPHA)
Vertical Resisting force at panel bottom = ((Wh * D/3) − (LF − WvD))/(LF)
Vertical Resisting force at outer end of foot = ((Wh * D/3) + (Wv * WvD))/(LF)

NOTE:
Negative foot forces are in tension, and indicate that a hold-down means is required, IE, spiking, sandbagging, etc. Positive forces are pressing into the ground. The spikes shown in the figures primarily resist the horizontal forces urging the berm wall to slide away from the contents. Properly set spikes can act in tension also.

TABLE II

| AXIOMS PERTAINING TO FREE-BODY CALCULATIONS |
|---|
| 1. THE BODY IS AT REST. |
| 2. ALL FORCES IN THE X, Y, OR Z AXIS EACH MUST SUM TO ZERO. Otherwise, the body is would be in motion. |
| 3. ALL TORSIONAL COUPLES AND FORCES MUST SUM TO ZERO. Otherwise, the body would be spinning. |
| 4. LINEAR FORCES MAY BE REPLACED BY ORTHOGONAL FORCES IN THE X, Y, AND Z AXIS. |
| 5. ORTHOGONAL FORCES MAY BE COMBINED INTO ONE FORCE. |
| 6. BY CONVENTION, FORCES SHOWN ARE SUPPORT OR ENVIRONMENTAL FORCES ACTING ON THE BODY, NOT FORCES FROM THE BODY TO THE ENVIRONMENT. |
| AXIOMS PERTAINING TO HYDRAULIC FORCES. |
| 1. HYDRAULIC FORCE AT ANY POINT IS THE DENSITY * DEPTH AT THAT POINT. THIS REPRESENTS THE WEIGHT OF A COLUMN OF THE FLUID OVER THE AREA UNDER INVESTIGATION. THE FORCE IS ZERO AT THE SURFACE AND MAXIMUM AT THE BOTTOM. |
| 2. AT ANY POINT WITHIN A FLUID, THE HYDRAULIC FORCES ACT EQUALLY IN ALL DIRECTIONS. |
| 3. TOTAL HORIZONTAL FORCE ON A VERTICAL RECTANGULAR SURFACE UNDER FLUID = W * D * D/2, WHERE D IS THE DEPTH OF THE FLUID, AND W IS THE WIDTH OF THE RECTANGLE. |
| 4. THE TOTAL FORCE ON A VERTICAL RECTANGULAR SURFACE MAY BE CONSIDERED AS CONCENTRATED AND ACTING ON A POINT 2/3 DEPTH BELOW THE SURFACE. |

OTHER EMBODIMENTS AND VARIATIONS

Figures 14, 15, 16, 17:
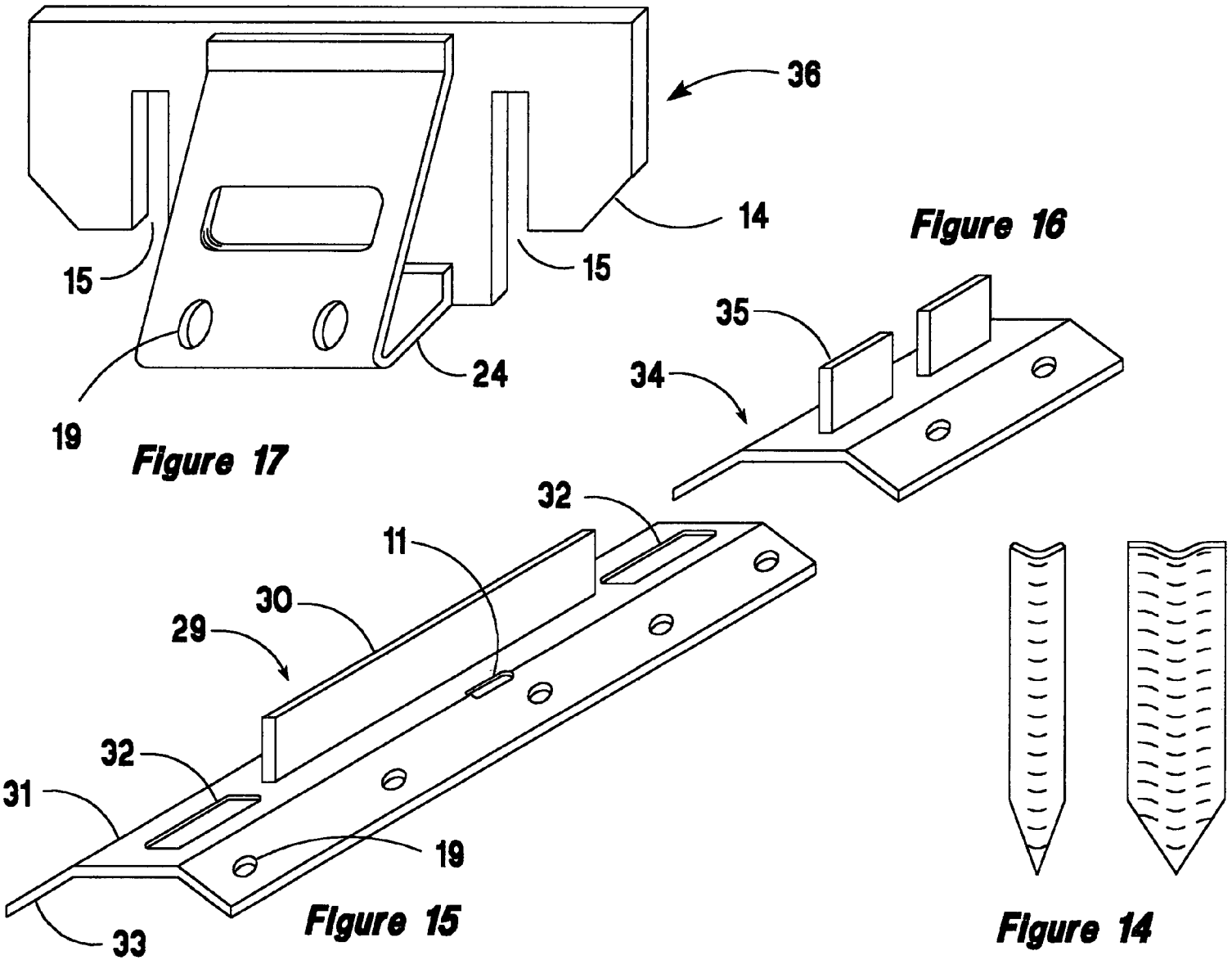
FIG. 14 is two embodiments of a drive post.
FIG. 15 is an isometric view of an alternative embodiment
FIG. 16 is an isometric view of the joining section for the alternative embodiment.
FIG. 17 is an isometric view of a straight joining clip and integral support gusset.

FIG. 12 shows a basic embodiment of the support gusset bracket. A stiffening member or rib along the diagonal edge may be added to resist buckling of the shear panel and to provide compression strength to the gusset. Obviously, the gusset bracket can be assembled from other common structural sections such as angle stock or T sections fastened to the triangular shear panel to form the wings, foot, or stiffener portions. FIG. 13 shows a bracket assembly with integral, non-removable wing and foot parts. The holes 26 of the FIG. 13 embodiment are for hanging the panel onto the structure of a drilling platform for storage and transportation of the berm as drilling rig equipment. FIG. 17 is the straight joining clip of the integral-bracket, for use with the embodiment shown in FIG. 13. In the field, the components of the FIGS. 1, 2, 3, 4, 5, 6, 13, and 17 are interchangeable and may be intermixed in the same berm.

FIG. 15 shows an embodiment 29 comprising a low berm wall 30 and an integral foot. This embodiment is to be used for small enclosures or for surrounding a larger work area. The low berm is less than 1 foot high to permit the crew to step over. The purpose is to contain the small amount of contaminants being tracked around by the crew, to divert water and mud away from the worksite, and to demark the immediate work area without presenting a general barrier such as the primary containment berm or a fence requiring a gate.

The foot 31 is illustrated as having gull-wings 33 which can be spiked, buried, or ice mortared to the ground. A flat T or L foot is a satisfactory alternative.

FIGS. 15 and 16 illustrate a pintle and gudgeon type joining. Blade 35 of the joining section 34 is passed through slot 32 at each end of the long panel piece 29. The footing of the joining section should be smaller than the matching section of the long piece to permit nesting of the two foot portions. The joining section may be bent to form a corner section or if the blade is a pin, then joined sections may be set at various angles. Separate joining sections may be eliminated altogether by having the long panel pieces comprising a blade 35 at one end and slot 32 at the other end.

The low berm can also be constructed with joining hooks as described in the preferred embodiment. Then joining is by appropriately scaled clips of the same style as previously described.

Obviously, the regular berm of FIG. 1 or the panels of FIG. 13 can be scaled down to perform the same function as the FIG. 15 embodiment, but the FIG. 15 embodiment is simpler, less expensive, and easier of use for the reduced requirements where a small barrier is needed.

The spikes 21 at the outward end (toe) of the support bracket foot 18 as illustrated in FIGS. 1 and 12 are present primarily to provide the horizontal forces, Rh, which oppose the tendency to slide the bracket along the ground. These spikes may be replaced by a downward pointing portion (not illustrated) at the toe end. This portion would be driven into the ground and present a significant vertical face under the soil to prevent horizontal sliding.

Similarly, the rear spikes resist both horizontal forces and provide the hold down forces to required prevent the inner end (heel) from rising. The rear spikes can be replaced by an extension on the T rib. When driven into the ground, the extension would provide pinning function and also tend press backwards against the ground and tend to lift a quantity of earth. Both of these can provide significant resistance to overturning.

In applications where the overturning moment is not severe, such as when retaining light materials, the support gusset bracket can be replaced by posts having An L, T, H, or V section driven into the earth. FIG. 14 shows two embodiments of a post. One is a simple V and the other has wings. In use, the edges of the V or the wings are slid into slots 8 or 17 in the same manner as the triangular gusset bracket.

While the figures illustrate depth of only one panel, the panels may be stacked to form 2 or 3 layer berms. Stacked panels use enlarged gusset brackets that support and vertically join the panels. An H-section bar or equivalent (not shown) can be used between stacked rows to add alignment and horizontal stiffening.

While the preferred method of forming a corner is to use a bent corner clip, it is within the optional configurations of the invention to bend the panel itself, thereby eliminating the corner clip entirely. Panels may also be bent into arcs for making curved bin walls.

Figure 8:
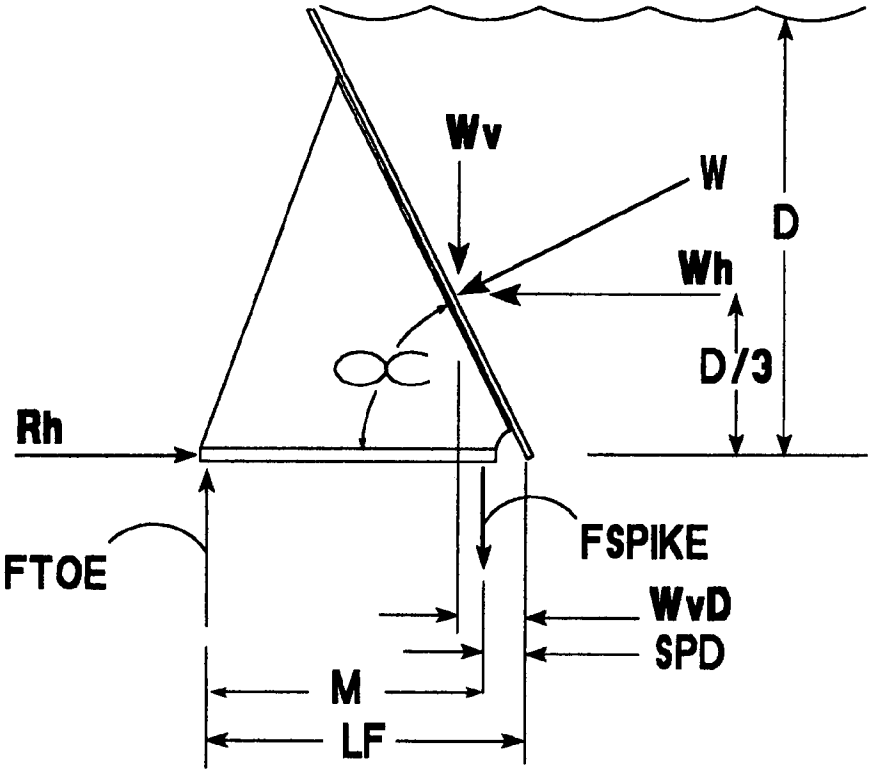
FIG. 8 is a free body diagram of an outwardly sloping berm wall
Figure 10:
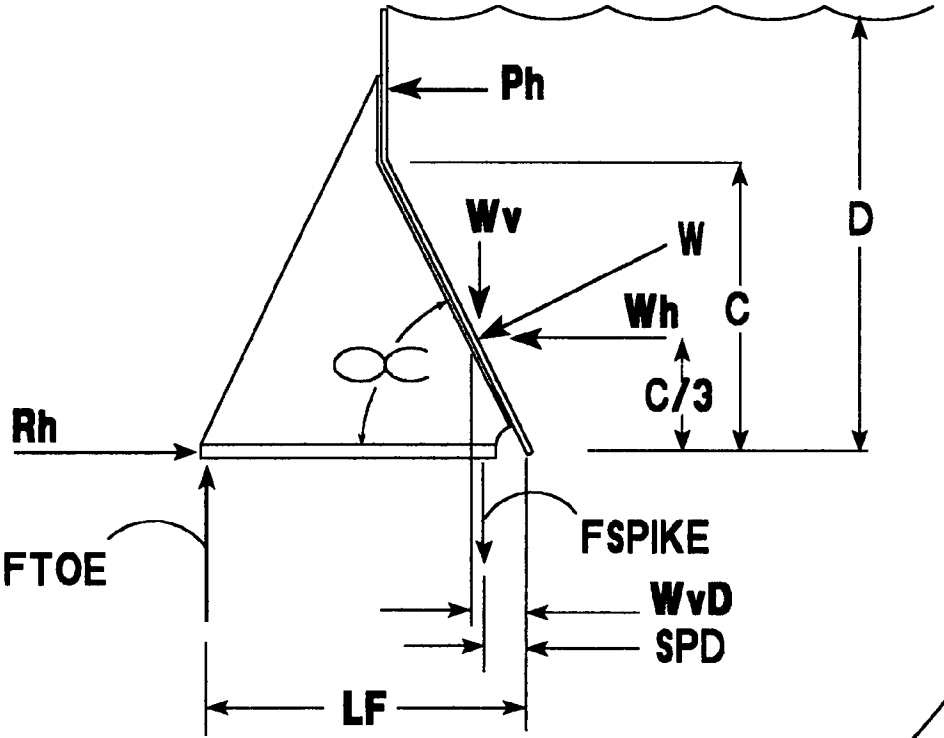
FIG. 10 is a free body diagram of a combined vertical and outwardly sloping wall.

The illustrations depict a bin or berm with vertical sides. Sloping berms can be installed by simply changing the angle of slots 16 to point inward at the open end, and constructing the gussets with an appropriate slope at the wings. The preferred berm wall slope is with the upper edge outward. FIGS. 8 and 10 show force diagrams for outward-sloping sided embodiments. The appropriate angles can be easily determined by simple trigonometry, scale drawings, or simple models.

Sloping makes a larger volume, but more importantly, the overturning moment is partly offset by the downward weight of the contents, and the bracket feet support the weight more evenly distributed over their entire area. FIG. 8 is the force diagram for a sloped wall. An outward slope of only 10 degrees (80 from horizontal) reduces the need for spiking hold-down at the heel to a few pounds. An outward slope of 20 degrees (70 from horizontal) will offset all overturning moments and not require any spiking tie-down whatsoever. Lengthening the foot pad on the gussets also reduces the amount of any heel lift to be restrained. The lift is never zero with vertical walls, and horizontal forces remain for all configurations.

There is nothing inherently limiting the angle of slope, but practical considerations suggest that 45 degrees is a maximum useful slope for a retaining bin wall. Larger slopes are practical when the bin wall is part of a materials handling feature such as a slope for aiding in loading or unloading the bin.

The figures also show two other optional embodiments to overcome the overturning moments. FIG. 10 shows a chamfered wall. The inward turn presents a horizontal projection of a surface upon which the weight of the berm contents acts. This geometry causes the center of pressure to move inward relative to a total sloping wall. The net effect is to use the sloping portion more effectively to offset the overturning moment. The overturning moment for all configurations relies only on the horizontal component of pressure on the face of the wall. The gravity derived moment resisting overturning relies only on the vertical component of pressure on any horizontal projection of sloped face.

The chamfer may be a whole panel, or an inwardly bent section of a panel at the bottom. When the horizontal projection of the sloping portion is small relative to the berm height, the preferred angle is from 0 (horizontal) to 45 degrees. Larger sloping portions can utilize larger angles. The more the sloping portion protrudes into the bin, the more effective it is in resisting overturning.

Figure 9:
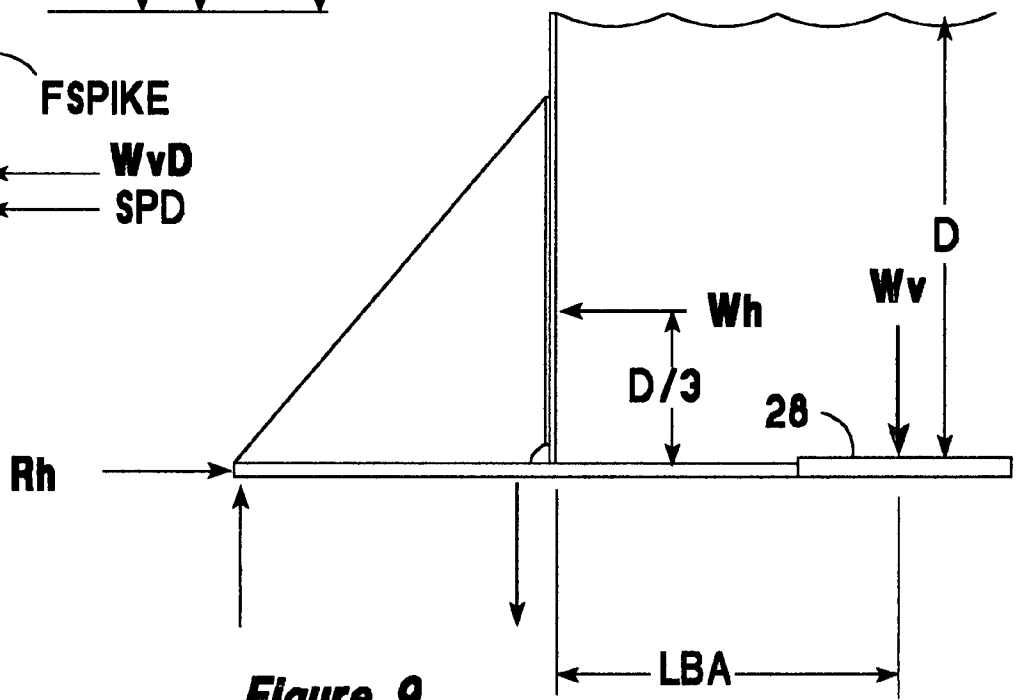
FIG. 9 is a free body diagram of a vertical berm wall with overturning-resisting foot pad.

Another embodiment is shown in FIG. 9. FIG. 9 shows an extension of the gusset foot under the berm liner. The weight of the material directly over the extension, which may be splayed into a paddle shape 28, provides considerable resisting moment to the overturning moment. Mathematically, there is no difference between the paddle and a horizontal extension of the panel.

The spring clip shown in FIGS. 1 and 11 is unbroken over its length. An optional feature is to cut series of slots a few inches apart. The cuts would be from the open edge to just below the beginning of the over-top curve. Such slots add flexibility and permit the clip to bend slightly and to conform to any panel curvature or to accommodate changing thickness in the liner due to folding, rivet heads, or other obstructions protruding from the panel surface.

The panel sections are easily handled by one or two workmen, but the liner for even a moderately size berm installation is heavy and awkward to handle. There is always a possibility that a forklift, which is seldom available, would damage the sheet. A specialized handling system to dispense the liner can be installed on a truck. Such a dispenser would be either a reel upon which a partly folded sheet is wound or a large flat storage/dispensing bin containing the liner folded zigzag into a pad, and is dispensed in the manner utilized by fire trucks to lay canvas fire hose.

Referring to FIGS. 18, 19, and 20, which illustrate an embodiment with the panel hooks, 4, turned 180 degrees, that is, facing inward toward the center of the panel. It is obvious that the disclosed invention works equally well with the panel hooks turned either outward toward the ends, or inward toward the center.

The joining clip of FIG. 21A is merely the clip of FIG. 4 with the central panel segment removed. The joining clip of FIG. 21B is a staple-like shape constructed of a bent rectangular bar or round rod. The joining clip of FIG. 21C hooks over the ends of the panel hooks thereby occupying the space between the hook and the panel in the same manner as the clips of FIG. 4 and FIGS. 21A and 21B. The clip of 21C requires some means to prevent the clip from sliding through the panel clips and falling off. Pins through holes, tabs across the gap at the top of the 21C clip or tabs across the bottom gap of the panel hooks, 4, are illustrative of typical means to hold the 21C clip in place.

It is also obvious that the connection assemblies comprising the panel hooks and the joining clips may be located on the interior side of the bin walls without diminishing their ability to form a material retaining berm as described.

It is also equally obvious that the hook may be closed as shown in FIG. 31. The joining clips of FIGS. 4, 21A, 21B and the prior clip 14 illustrated in FIG. 20 will cooperate with the attachment pocket "hook" of FIG. 31. It is also obvious that the hat section forming the channel 37 is a modification of the open hook 4. It is also obvious that the a tube of rectangular or round cross section attached to the panel face will perform the same function as the hat section illustrated.

It is also obvious that an elongated clip 14 will function both as a panel and joiner. It is also equally obvious that instead of elongating a clip, thus having two styles of panels, the regular panes can be fitted with one end having hooks 4 or 37 of FIG. 37.

While only the straight-joining embodiments are illustrated, a bend in the center of the joining clip as shown in FIGS. 6 and 18 adapts the joining clip or equivalent for use as a corner joining element. Similarly, other embodiments of panel joining methods are illustrated as overlapping panels, corner pieces are either short panels with a dihedral bend near the center, or are long panels with a bend somewhere along the length. The preferred method is to employ short panels adapted for corner use.

Figures 22, 23, 24:
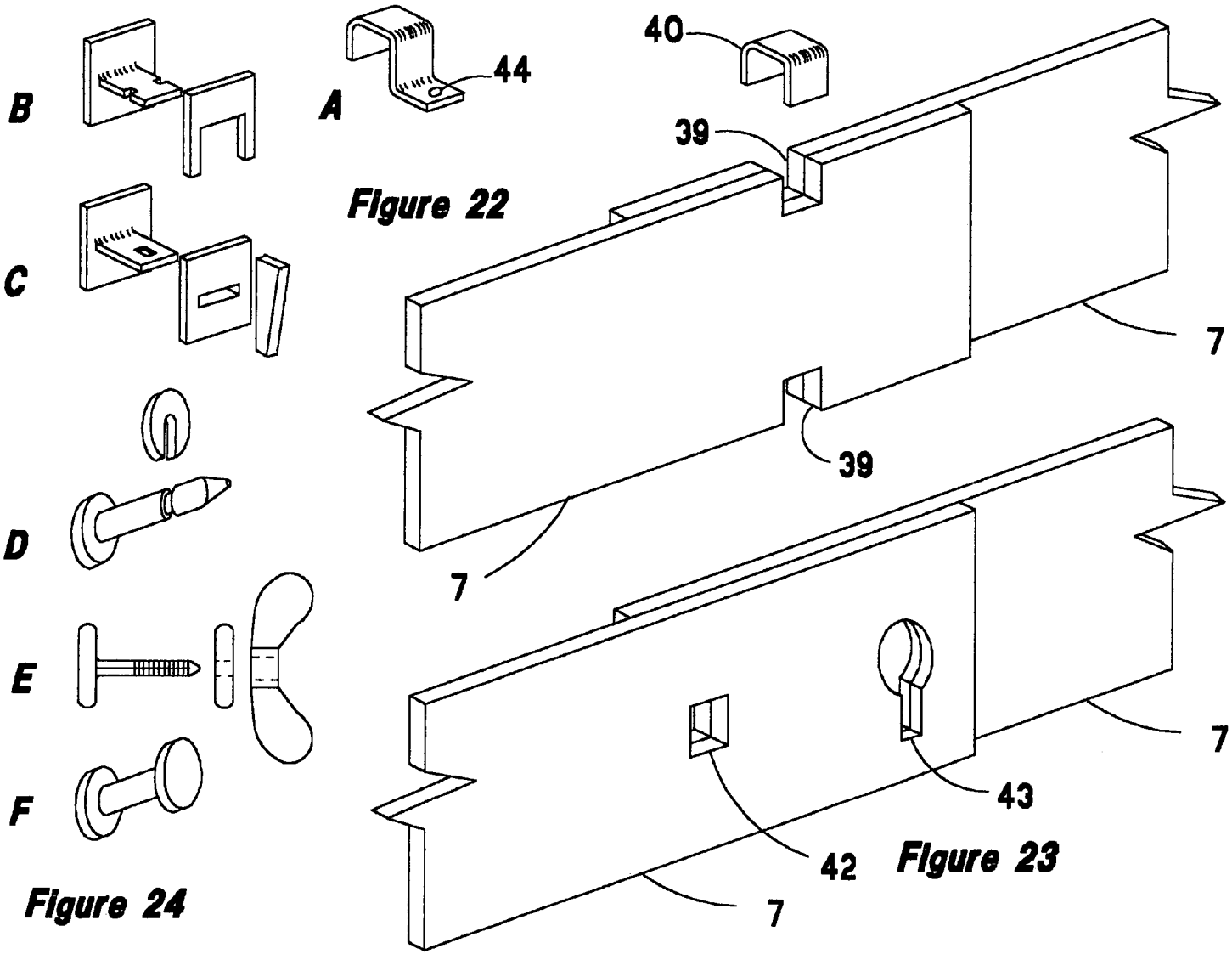
FIG. 22 shows an alternative means for joining panels.
FIG. 23 shows two variations of joining as depicted in FIG. 22
FIG. 24 shows a variety of panel joining clamps.

Referring to FIGS. 22, 23, and 24. In these illustrations, overlapping panels are joined by employing a clamping means to hold them securely together and preventing significantly separation motion in any direction. FIG. 22 illustrates simple matching notches for receiving an interposing element.

FIG. 23 illustrates alternatives to edge notches as holes through the panels. Two are shown, a rectangular hole 42 and a key-hole 43. Obviously other hole shapes such as circular, oval, and slots can be employed. Not specifically illustrated, but a plurality of notches and/or holes along the length of a panel permits two panels to be joined with varying overall length, that is, with a kind of telescoping action.

FIG. 24 illustrates several clamping means. 24A is an improved version of that shown in FIGS. 22 and 23, where the hole 44 on the tab is intended to carry a securing means connecting two or more clamps with a wire, plastic strap, rod or nail, or long bolt, and the like.

FIGS. 24B and 24C are pins with retaining elements that cooperatively engage slots in the shank to form a retaining head for the assembly.

FIG. 24C is similar, except the retention function is provided by a tapered pin or a nail-like pin.

FIG. 24F is a double headed pin operating in the manner of the U clips shown. The embodiment shown has a round pin and heads, but other shapes are to be implied as within the concept. In fact, H shape extrusions can be cut from long stock and will serve admirably within this embodiment's functions.

FIG. 24E is illustrated as a bolt system with an oversize wing nut. The nut assembly must be large enough and shaped adequately so it can be turned with a heavily gloved hand. A fluted knob, a handle similar to a water valve handle, a crank extending from the nut, or the like will serve equally well for arctic winter use. For warmer climes, ordinary nuts will do.

Figures 25, 27:
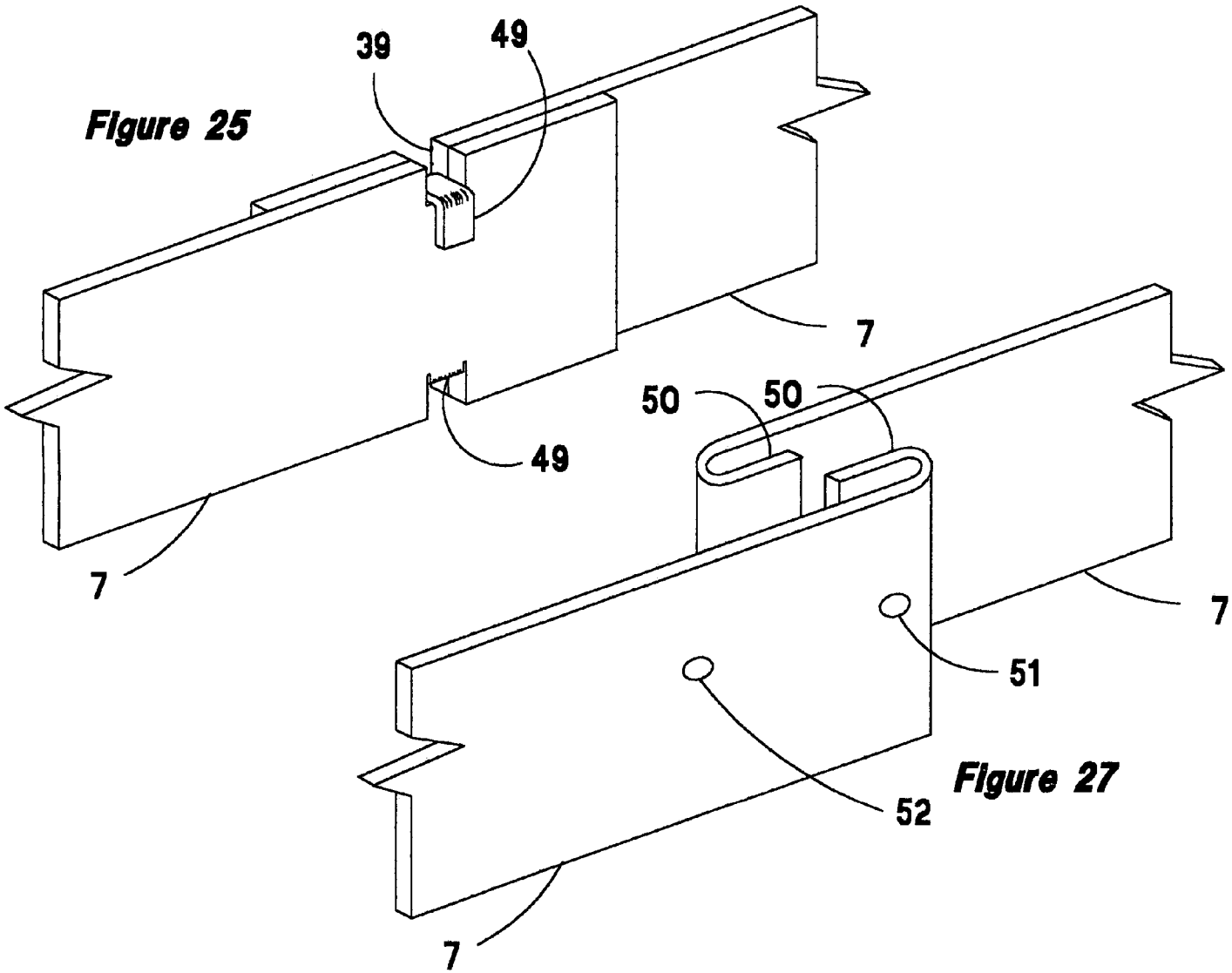
FIG. 25 is a variation of the method depicted in FIG. 22.
FIG. 27 is another method of joining panels.

Another panel joining or clamping means based on the U clamp of FIG. 24A is shown in FIG. 25.

The portion of notch 49 that is usually cut away, is bent over to form the functional equivalent 49 of separate clamp 40 and 24A. The U hook at the top is on one panel and the U hook at the bottom is on the other panel. These two are slid into the corresponding notches to latch two panels together.

While the drawings and the above paragraph describe an embodiment of the U hook utilizing the material freed up by cutting the notches, it is obvious that the U hooks can be made from separate pieces attached to the panel by welding, bolting, riveting, or any other suitable fastening means. It is also obvious that the hooks may be attached to the sides of the slots instead of the bottoms of the slots with minor adaptation in fabrication technique. Remarks: The inclusion of hook attachment by welding, etc instead of being formed from parent material is readily anticipated by anyone skilled in the art. Therefore, such alternative embodiments for the hook attachment is implicit in the original specification and drawings. Furthermore, separate hook fabrication would be the preferred material in moderate quantity production where the notches would be punched Instead of sawed. Punching with commonly available punches is not likely to leave an adequate, or often any, tang for bending into a hook.

FIG. 27 shows another embodiment of joining clips 50 comprising reverse turns fixedly attached to the ends of the berm panels. Hole 51 through the 4 layers in glad-hand configuration is to receive a pin to lock the assembly together. Hole 52 is an alternative position for the pin. Pin 52 goes through only one panel face and comprises a stop to prevent the latched glad-hand joining from separating in an axial direction.

Figure 32:
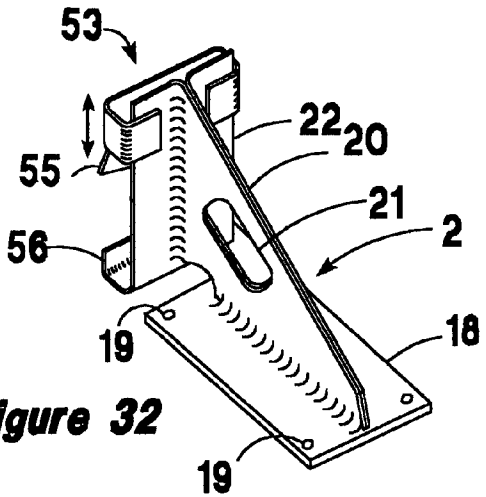
FIG. 32 shows a support bracket with sliding panel joining clamps.

FIG. 32 shows an upper and lower clamp combined with a support bracket 2. It is not necessary to incorporate the gusset/foot assembly for use as a panel clamp. Rib 22 has a lower J hook to receive the notches at the bottom of a pair of panels. Sliding clamp 53 is comprised of a portion that co-operates with rib 22 to slide along the length of rib 22, and a beak portion 54 which forms the co-operating holding means to clamp the upper edges of the panels within their notches. As shown, the beak is at an angle, sloping away from rib 22. When dropped onto the panel edges or notches, this creates a wedging action against the bottom edges of the panel notches firmly clamping the panels together. The adjustable panel clamping device described and shown in FIG. 32 can be used with varying panel widths and even without panel notches. Obviously, the J hook at the bottom and the slider-hook can be configured to attach through the hole configurations previously described. More than one slider 53 can be used on a rib so the design of FIG. 32 can be used on vertically stacked panels. The rib 22 may also be fitted with features to perform other useful functions, such as drive points to be driven into the ground, sand bagging pads, or extensions projecting under the berm lining to resist overturning as shown in FIG. 9, etc.

Rib 22 may be fitted with co-operating attachment means so the gusset and foot portions 20 and 18 may be separate and removable from the rib 22.

Figures 28, 29, 30:
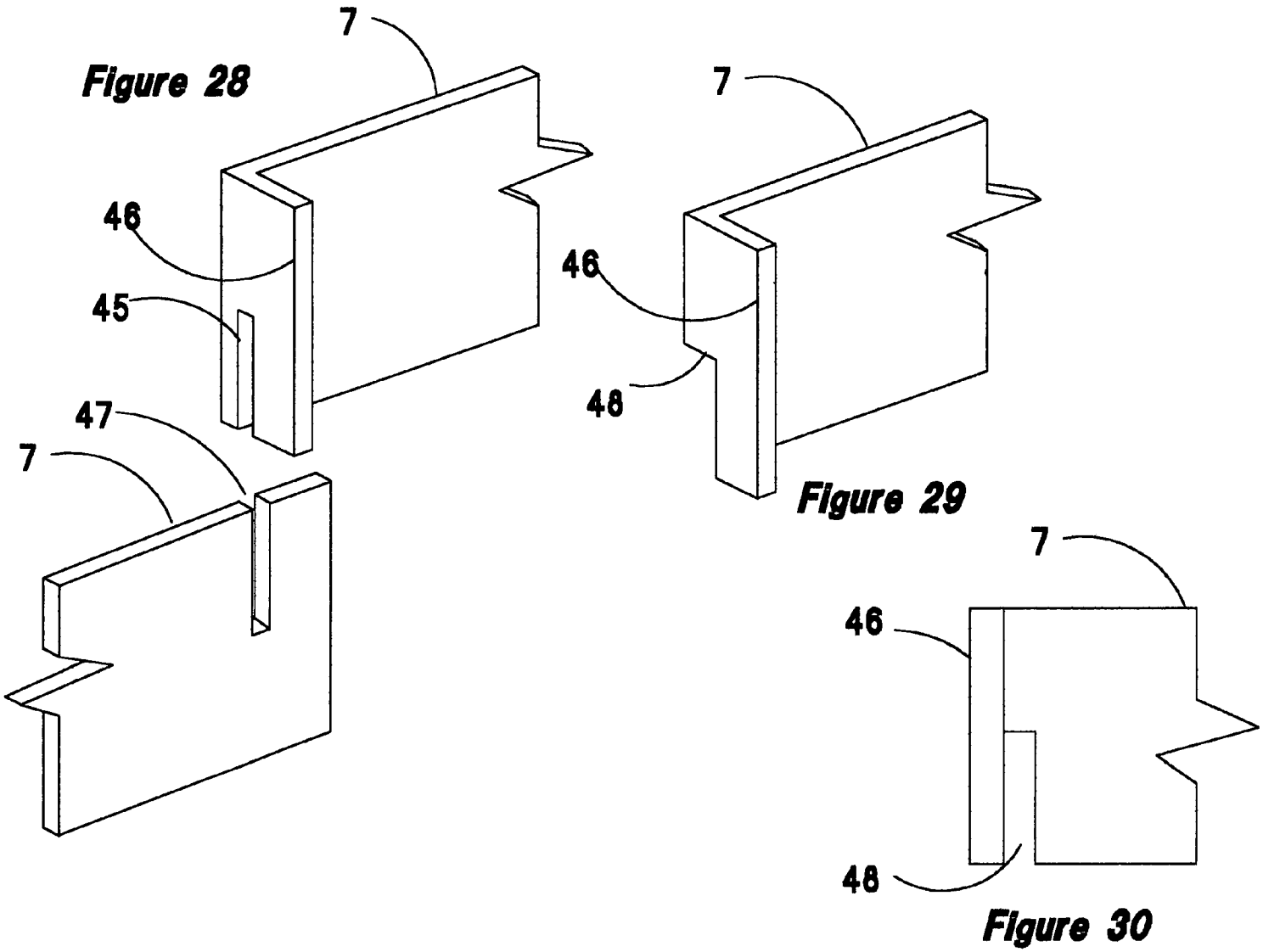
FIG. 28 is another method of joining panels.
FIG. 29 is a variation of the method described in FIG. 28, but permitting joining at corners.
FIG. 30 is a detail illustrating a hidden part of the slot shown in FIG. 28.

Referring to FIGS. 28, 29 and 38. These panel joining embodiments do not require additional securing parts. Cooperating slots lock the panels together. The figures show the ends of adjacent panels. However, the same figure details can be interpreted for panel construction as illustrating each end of one panel. FIG. 28 is the basic concept for in-line joining. Co-operating slots 45 and 47 interdigitate to connect two panels. If the slot 45 of FIG. 28 is moved from the end bend 46 to the panel face, it will connect panels at approximately 90 degrees. FIGS. 29 and 30 illustrates the end panel slot 45 and face slot being combined as a single slot appearing on both end bend and panel face 48. Thus, with this arrangement a pair of panels may be joined either in-line or at right angles. Moreover, because the end and panel slots are merged into one, the joint may take up any exterior angle from 0 to ±90 degrees or slightly more. FIG. 30 shows the panel-face slot more clearly than does FIG. 29. Internal bend radiusing is presumed, but not illustrated. Slight modification of the slotting may be required to accommodate whatever bend radius is utilized. Bend radius is a function of the material and process for the bending, so some minor experimentation is probable for optimization. Alternatively, angle pieces may be attached to the panel to form the bend. Doubler plates on either or both the panel face and the bended extension will serve both to cover the bend radius and to provide additional strength to the assembly.

FIG. 38 shows a simple slot connector for right angle connection.

Figure 33:
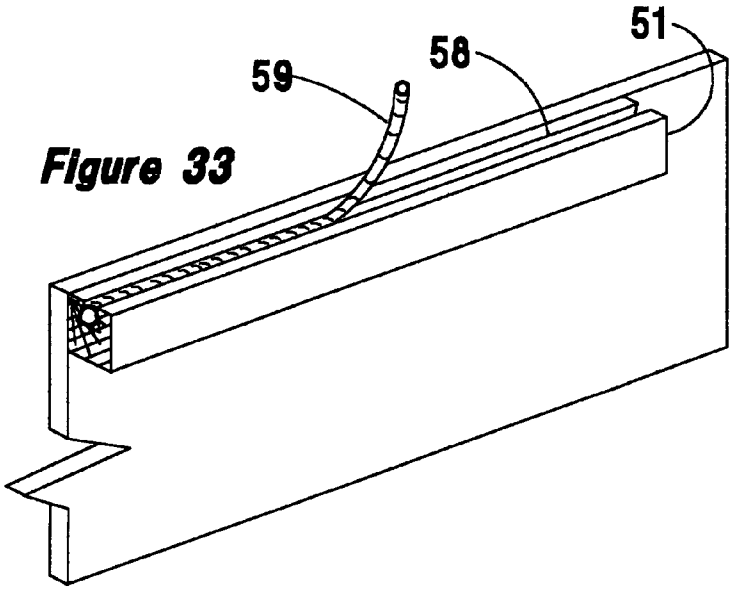
FIG. 33 shows a liner clamp method using a slot and elastic "noodle" as retaining means.
Figure 36:
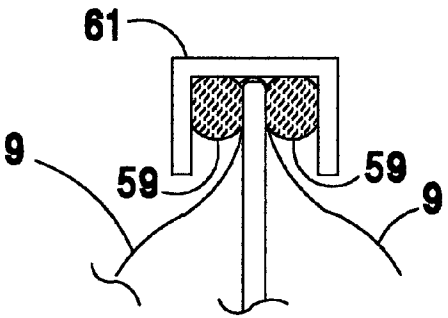
FIG. 36 shows another alternative liner clamping means using elastic noodles.
Figure 35:
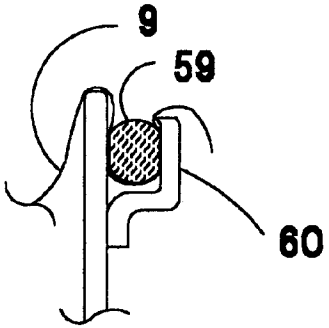
FIG. 35 shows an alternative to the slot embodiment.

FIGS. 33, 35, and 36 show methods of securing the berm liner 9 using a cord in groove techniques. A wood strip or waler 57 or similar with an elongated groove 58 is attached to the top edge of a panel. Liner 9 is placed over the groove and a cord of flexible material 59 such as rubber, plastic, or rope is pushed into the groove carrying the liner into the groove and holding it there by friction. FIG. 35 shows an all sheet metal embodiment. Flange 60 forms the groove. Otherwise, the system functions as shown and described above.

FIG. 36 shows a channel structure carrying two cords and used as a cap over the panel 7 with the liner 9 trapped and clamped by the cords.

Figure 34:
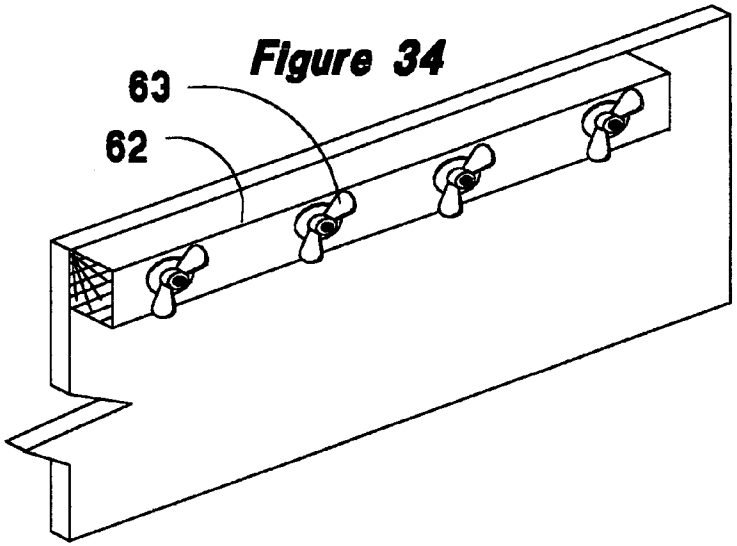
FIG. 34 show an alternative liner clamping method.

FIG. 34 shows the board as part of a clamping system utilizing bolts and large wingnuts. Other clamping mechanisms such as described elsewhere in this disclosure may be used in place of the bolt and wingnut means. The wooden walers can also be nailed to in the manner of the prior art timber berms.

Figure 39:
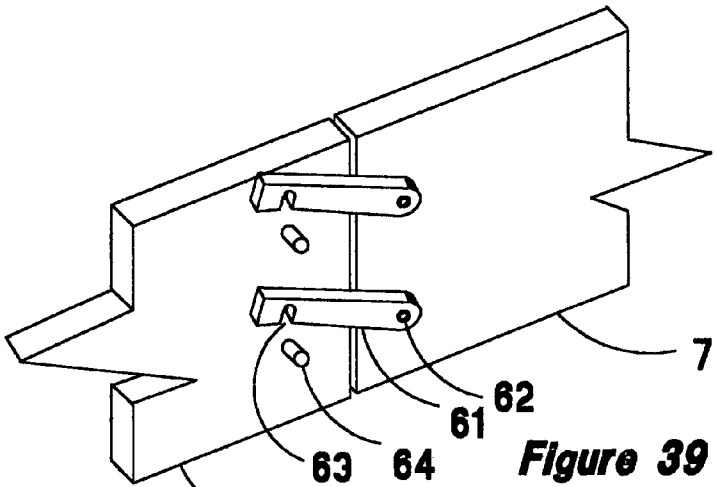
FIG. 39 shows two panels joined utilizing pivoting hooks and cooperating pintles.

FIG. 39 depicts a hook and eye type joining system with a hook 61 having a hooking slot 63 pivoted on a pin 62. Hook 61 is rotated to engage the hooking slot 63 with the co-operating hooking pin 64, thereby preventing movement between the berm panels 7.

It is obvious that the same way, structure, and result also applies to a minor variation where the pins 64 are replaced by a hole in a projecting plate or by a loop of rod like material which receives the portion of the swinging arm beyond the slot 63 in the manner of a common hook-and-eye latch.

Figure 40:
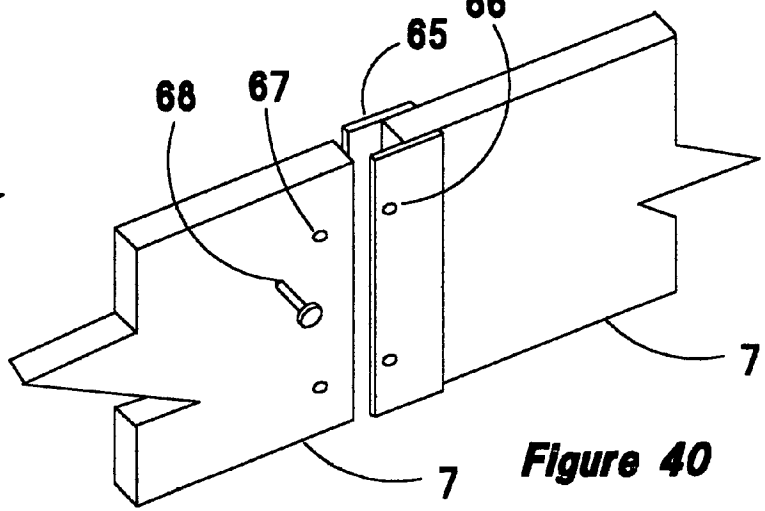
FIG. 40 shows two panels utilizing overlapping wing like projections for alignment and secured by pins through both panels.

FIG. 40 depicts one panel fitted with guide wings 65. Coaxial holes 66 and 67 receive a pin 68 to secure the two adjacent berm panels in a fixed position. Holes 67 and 68 may be slotted vertically to permit some vertical adjustment between the panels. Similarly, horizontal slots will permit some re-alignment in the plane of the panels to accommodate changing slopes of the terrain on which the berm is installed.

Figure 41:
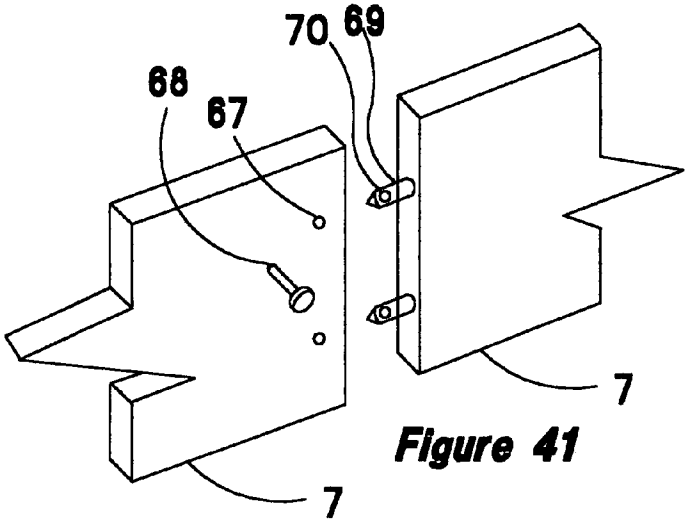
FIG. 41 shows two panels joined utilizing pins and sockets axially aligned with the panel axes and secured by pins through the panels and joining pins.

FIG. 41 depicts joining pins 69 and co-operating receiving holes in the plane of the panels 7. The joining pins have holes 70 to receive a retaining pin 68 through panel holes 67 to lock the assembly together.

Figure 42:
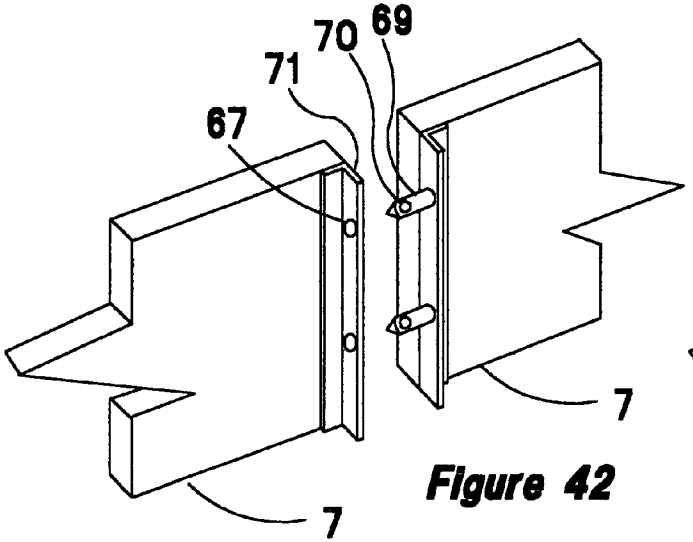
FIG. 42 shows two panels joined by an alternative embodiment of the pin and socket system of joining panels.

FIG. 42 is a variant on the embodiment of FIG. 41. Because most panels in the preferred embodiment are not thick enough to support axial pins as shown in FIG. 42, artificial thickness is introduced as perpendicularly projecting wings 71 which do have adequate space for the joining pins 70 and co-operating receiving holes 67.

The assembly is secured by individual pins or a common pin (rod) through securing holes 70.

It is obvious that the several details and sub-assemblies of the various embodiments may be intermixed and/or used individually or in combination to join the berm panels It is also obvious that many of the various sub-assemblies and parts may be dispersed between adjoining berm panels to provide symmetry so a panel may be installed without having to turn ends to make a matching pair of joining means.

HOW TO USE THE INVENTION

The job site details will determine the minimum size and placement of the berm and in some cases site conditions limit the maximum height that can be installed to avoid interference with operations of machinery in and around the berm.

To customize the present invention for a particular installation, an estimate is made of how much volume should be contained for protection against a worst-case spill scenario and to meet industry and legal standards.

Then the volume of the proposed berm enclosure is calculated and compared to the worst-case requirement. If the proposed berm is too small, the perimeter or height has to be enlarged and recalculated. The various mensuration formulas to compute volumes of regular and irregular shapes are readily available. Formulas, charts, and nomograph can be provided in the installation kit of instructions. The ability to perform the calculations should be within the ordinary skill of an engineer or mechanic assigned to specify containment system described herein. It should also be within the ordinary skill of the mechanic assigned to oversee the installation of the containment berm system with the aid of installation charts, graphs, and nomographs to be supplied with the installation kit.

The route of the berm is laid out on the ground, the panels, gusset brackets, spikes, liner, and clips are brought to the job site and erected similarly to the illustration of FIG. 1.

The various panels are joined by sliding the slots in the joining clips over the hook at the end of the panel. The support gusset brackets are slid into the channels provide to attach them to the panels. The gusset brackets are spiked to the ground, the liner is tucked into the corners and pulled over the rim. When all is in place the liner retaining clips are installed and the berm is complete, ready to receive a spill and protect the surrounding environment.

The alternative means for joining panels are used similarly, the assembly details should be obvious from the description and drawings.

The berm system as described may also be used as storage bins for bulk storage, walls for small low buildings, ditching or ditch liners, diversion dams, light duty retaining walls, and flood or run off water diking or diversion.

It is recognized that one skilled in the art will perceive other embodiments and variants in the spirit and nature of the invention. It is intended that such embodiments and variants are included within the monopoly extended by patent.

The embodiments of the invention in which an exclusive property right or privilege is claimed are defined as follows:

We claim:

1. A materials retaining berm system comprising:

a. at least three elongated panels each having a top edge, bottom edge, first and second faces, first and second ends, and first and second joining means located on the first face at said first and second ends; and b. said joining means being joining hooks comprising first and second portions, wherein the second portion extends from the first portion, the first portion being fixedly attached adjacent the first and second ends of the first panel face and the second portion extending toward the center of the first panel face and being spaced apart from the first panel face, the second portion being substantially parallel to the first panel face, thereby forming a slot for receiving a joining clip; and c. at least three joining clips for removably joining two said panels, said joining clips having first and second end portions adapted to engage said extending portion of the joining hooks of adjacent panels and to occupy the slots; and d. whereby said panels connected by said joining clips define an enclosed space for retaining materials therein.

2. The materials retaining berm system of claim 1 where said joining means is a channel oriented transversely to the axis of said elongated panel for receiving a cooperating joining clip; and at least three joining clips for removably joining two said panels, said joining clips having first and second end portions bent approximately at right angles to a portion extending between and attached to said end portions, where said end portions of said joining clips cooperate with said channels to join two said elongated panels.

3. The material retaining berm of claim 1 where said joining clip is comprised of a central portion having retro bends of approximately 360 degrees on opposing ends of said central portion, thereby forming hooks adapted to cooperatively engage the inward facing hooks on the ends of said elongated panels.

* * * * *